US007558519B2

(12) United States Patent
Jinzai et al.

(10) Patent No.: US 7,558,519 B2
(45) Date of Patent: Jul. 7, 2009

(54) ENDLESS METALLIC BELT AND FIXING BELT AND HEAT FIXING ASSEMBLY MAKING USE OF THE SAME

(75) Inventors: Makoto Jinzai, Abiko (JP); Yasuhiro Hayashi, Moriya (JP); Kazuo Kishino, Yokohama (JP); Yaomin Zhou, Hanno (JP); Junichi Takahashi, Chichibu (JP)

(73) Assignee: Canon Kabushiki Kaisha, Tokyo (JP)

( * ) Notice: Subject to any disclaimer, the term of this patent is extended or adjusted under 35 U.S.C. 154(b) by 357 days.

(21) Appl. No.: 11/687,963

(22) Filed: Mar. 19, 2007

(65) Prior Publication Data

US 2007/0223979 A1 Sep. 27, 2007

(30) Foreign Application Priority Data

Mar. 22, 2006 (JP) ..... 2006-078358

(51) Int. Cl.
*G03G 15/20* (2006.01)

(52) U.S. Cl. ..... 399/329; 399/333

(58) Field of Classification Search ..... 399/320, 399/328, 329, 333
See application file for complete search history.

(56) References Cited

U.S. PATENT DOCUMENTS

| | | | | |
|---|---|---|---|---|
| 6,561,001 | B2 | 5/2003 | Sakuma et al. | 72/85 |
| 6,564,033 | B2 | 5/2003 | Zhou et al. | 399/329 |
| 6,989,397 | B1 | 1/2006 | Richardson et al. | 399/159 |
| 7,200,354 | B2 | 4/2007 | Nakamoto et al. | 399/329 |
| 7,215,916 | B2 | 5/2007 | Kishino et al. | 399/329 |
| 7,263,306 | B2 | 8/2007 | Hayashi | 399/70 |
| 7,376,379 | B2 * | 5/2008 | Takahashi et al. | 399/329 |
| 2005/0100373 | A1 | 5/2005 | Kishino et al. | 399/329 |
| 2007/0059065 | A1 | 3/2007 | Takada et al. | 399/329 |
| 2007/0127958 | A1 | 6/2007 | Matsuura et al. | 399/328 |
| 2007/0140760 | A1 | 6/2007 | Nakamoto et al. | 399/329 |
| 2007/0147914 | A1 | 6/2007 | Takahashi et al. | 399/329 |
| 2007/0147915 | A1 | 6/2007 | Kishino et al. | 399/329 |
| 2007/0231026 | A1 | 10/2007 | Hayashi et al. | 399/329 |

FOREIGN PATENT DOCUMENTS

| | | |
|---|---|---|
| JP | 9-034286 | 2/1997 |
| JP | 2001-225134 | 8/2001 |
| JP | 2002-241984 | 8/2002 |
| JP | 2002-258648 | 9/2002 |
| JP | 2005-165291 | 6/2005 |

* cited by examiner

*Primary Examiner*—Hoang Ngo
(74) *Attorney, Agent, or Firm*—Fitzpatrick, Cella, Harper & Scinto

(57) ABSTRACT

An endless metallic belt formed of a nickel alloy which contains at least one element selected from the first group of elements consisting of phosphorus, boron, silicon, germanium, selenium, antimony, tellurium, bismuth and astatine, and, in an X-ray diffraction pattern of which, half widths of X-ray diffraction peaks of the (111) crystal plane and (200) crystal plane are both from 0.5° to 2.5°.

5 Claims, 4 Drawing Sheets

ENDLESS METALLIC BELT AND FIXING BELT AND HEAT FIXING ASSEMBLY MAKING USE OF THE SAME

BACKGROUND OF THE INVENTION

1. Field of the Invention

This invention relates to a heat fixing assembly, and a fixing belt, of image forming apparatus such as electrophotographic apparatus and electrostatic recording apparatus, and to an endless metallic belt used in these.

2. Related Background Art

In image forming apparatus, heat roller type or belt heating type assemblies have been in wide use as fixing assemblies with which unfixed images (toner images) of intended image information which have been formed and held on recording mediums (such as transfer material sheets, electrofax sheets, electrostatic-recording paper, OHP sheets, printing paper and format paper) by a transfer method or a direct method at zone where an image formation process such as an electrophotographic process, electrostatic recording process or magnetic recording process is carried out are heat-fixed to the recording medium surfaces as permanently fixed images.

As materials for belts in such a belt heating method, heat-resistant resins are used. In particular, polyimide resins are used, which have superior heat resistance and strength. However, such resin belts have insufficient strength for meeting a demand for further high speed and high durability. Accordingly, it is proposed to use a belt made of a metal such as SUS stainless steel, titanium, nickel or the like as a base material.

Seamless (endless) belt base materials made of SUS stainless steel are obtained by plastic working such as spinning (see Japanese Patent Application Laid-open No. 2001-225134). In general, belts made of SUS stainless steel which are obtained by plastic working (such as rolling, drawing or spinning) stand unable to deal with the achievement of smaller diameter of endless fixing belts (18 mm or less in diameter) and the achievement of smaller wall thickness of fixing belt base materials (15 μm or less in thickness), as required in small-sized, high-speed and highly durable fixing assemblies. Then, because of a difference in stress distribution between the lengthwise direction and the circumferential direction, there is a possibility of causing cracks gathered in one direction. There are also limits for the length, diameter, thickness and dimensional precision of belts obtainable by the plastic working.

Seamless (endless) belt base materials made of nickel are commonly produced by electroforming making use of a nickel sulfamate bath or a nickel sulfate bath (see Japanese Patent Application Laid-open No. H09-034286). As electroformed nickel materials used in fixing assemblies of a high-frequency electromagnetic induction heating system, electroformed nickel materials are used which are usual gloss electroformed nickel materials improved in heat deterioration resistance (see Japanese Patent Application Laid-open No. 2002-258648).

On the sliding surface of such an electroformed nickel belt, a sliding layer formed of a polyimide or the like is provided in some cases in order to supplement wear resistance. However, what are called resin type materials including polyimides have thermal resistance which is larger by about 300 times that of the base material nickel, and hence require a long fixing rise time to loose an advantage the well heat-conducting nickel materials have. For single-metallic electroformed belts, it is difficult to have properties which satisfy all requirements of wear resistance, heat resistance, flexing resistance and durability. Combination of various metallic elements makes it possible to obtain electroformed belts having better properties.

A technique is proposed in which at least one of metallic elements belonging to Group 2, Group 3, Group 4 and Group 5 of the periodic table is incorporated in a proportion of from 10 to 10,000 ppm as mass fraction to control the growth of nickel plating crystals to make the crystals grow orderly so that the crystals of nickel may strongly be oriented to the (200) crystal plane, and also crystal transition temperature is raised to improve heat aging resistance and durability of the electroformed belts. However, there has still been room for improvement with regard to wear resistance, flexing resistance, heat resistance and durability which are required in fixing belts for compact and high-speed fixing assemblies (see Japanese Patent Application Laid-open No. 2002-241984).

In a nickel alloy containing 5% by mass or more of a different metal(s) other than nickel, half widths of diffraction peaks of the (111) crystal plane and (200) crystal plane in an X-ray diffraction pattern of a metallic layer are both made to be 0.5 to 2.0 by defining the half widths, and this enables securement of sufficient wear resistance and durability (see Japanese Patent Application Laid-open No. 2005-165291). However, the nickel alloy may inevitably have a low thermal conductivity because the different metal(s) is/are in an amount of as large as 5% by mass or more, or may inevitably have a low electromagnetic induction heating efficiency when applied in fixing assemblies of the high-frequency electromagnetic induction heating system. Accordingly, it has been necessary for the different metal(s) to be contained in a small quantity.

SUMMARY OF THE INVENTION

Endless metallic belts used in electrophotographic apparatus, electrostatic recording apparatus and the like must have a long-term durability (running performance). Further, as heat fixing assemblies have been made compact, high-speed and high-performance, endless metallic belts are required to have wear resistance, flexing resistance and heat resistance.

The present invention has been made in order to meet the above requirements, and its object is to achieve improvements in flexing resistance, heat resistance and durability while maintaining wear resistance of the endless metallic belt formed of an electroformed nickel alloy.

The above object is achieved by the present invention described below.

The present invention is concerned with an endless metallic belt formed of a nickel alloy; the nickel alloy containing at least one element selected from the first group of elements consisting of phosphorus, boron, silicon, germanium, selenium, antimony, tellurium, bismuth and astatine, and, in an X-ray diffraction pattern of which, half widths of X-ray diffraction peaks of the (111) crystal plane and (200) crystal plane are both from 0.5° to 2.5°.

Further features of the present invention will become apparent from the following description of exemplary embodiments (with reference to the attached drawings).

BRIEF DESCRIPTION OF THE DRAWINGS

FIG. 5A: no internal stress, FIG. 5B: macroscopic internal stress, and FIG. 5C: microscopic internal stress.

DESCRIPTION OF THE EMBODIMENTS

The fixing belt which is a working example of the present invention is described below.

Figure 1:
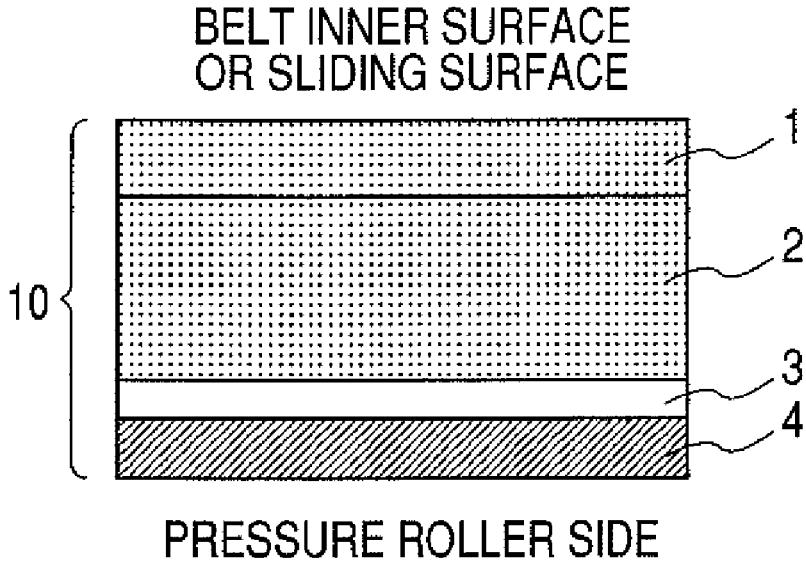
FIG. 1 is a diagrammatic view showing an example of the layer configuration of the fixing belt of the present invention.

FIG. 1 is a diagrammatic view showing an example of the layer configuration of the fixing belt. A fixing belt 10 has a composite structure having a belt base material 1 constituted of the endless metallic belt of the present invention, a silicone rubber elastic layer 2 layered on the outer surface of the base material, and a releasing layer (e.g., a PFA tube) 4 with which the silicone rubber elastic layer 2 is covered via an adhesive layer 3. In the fixing belt 10, the inner surface of the endless metallic belt is on the belt inner surface side (belt guide surface side), and the releasing layer 4 is on the belt outer surface side (pressure roller side). A primer layer (not shown) may also be provided between the belt base material 1 and the silicone rubber elastic layer 2 for the purpose of their adhesion. The primer layer may be formed using a known primer of a silicone type, an epoxy type, a polyamide type or the like, and may usually have a thickness of approximately from 1 to 10 μm. The nickel alloy according to the present invention has a sufficient wear resistance, and hence the inner surface or outer surface of the endless metallic belt may serve as a sliding surface as it is so that any sliding layer can be omitted. However, a sliding layer formed of, e.g., a polyimide may be provided on the sliding surface of the fixing belt.

Figure 2:
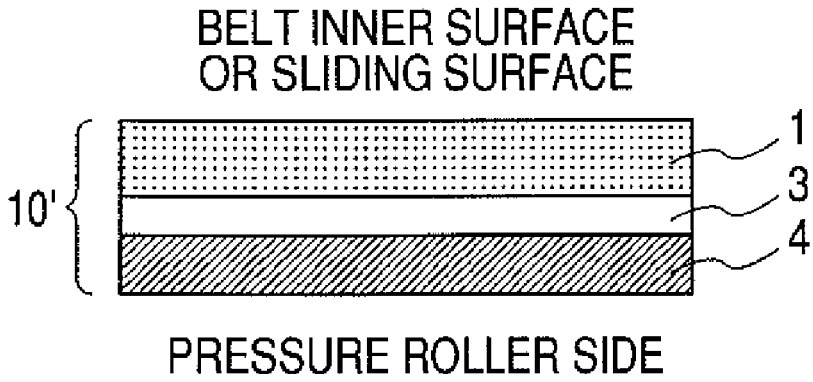
FIG. 2 is a diagrammatic view showing another example of the layer configuration of the fixing belt of the present invention.

FIG. 2 is a diagrammatic view showing another example of the layer configuration of a fixing belt 10' in an example of the present invention. This is an example in which any elastic layer 2 is not formed on the surface of a belt base material 1 and a releasing layer 4 is formed via an adhesive layer 3. Especially where monochromatic images having a small quantity of toner borne on a recording medium and toner layers of which have a relatively small unevenness are heat-fixed, a form may be employed in which such an elastic layer 2 is omitted. In the case of the fixing belt 10' as well, a sliding layer formed of, e.g., a polyimide may be provided on the inner surface of the fixing belt, but may not necessarily be required.

Figure 3:
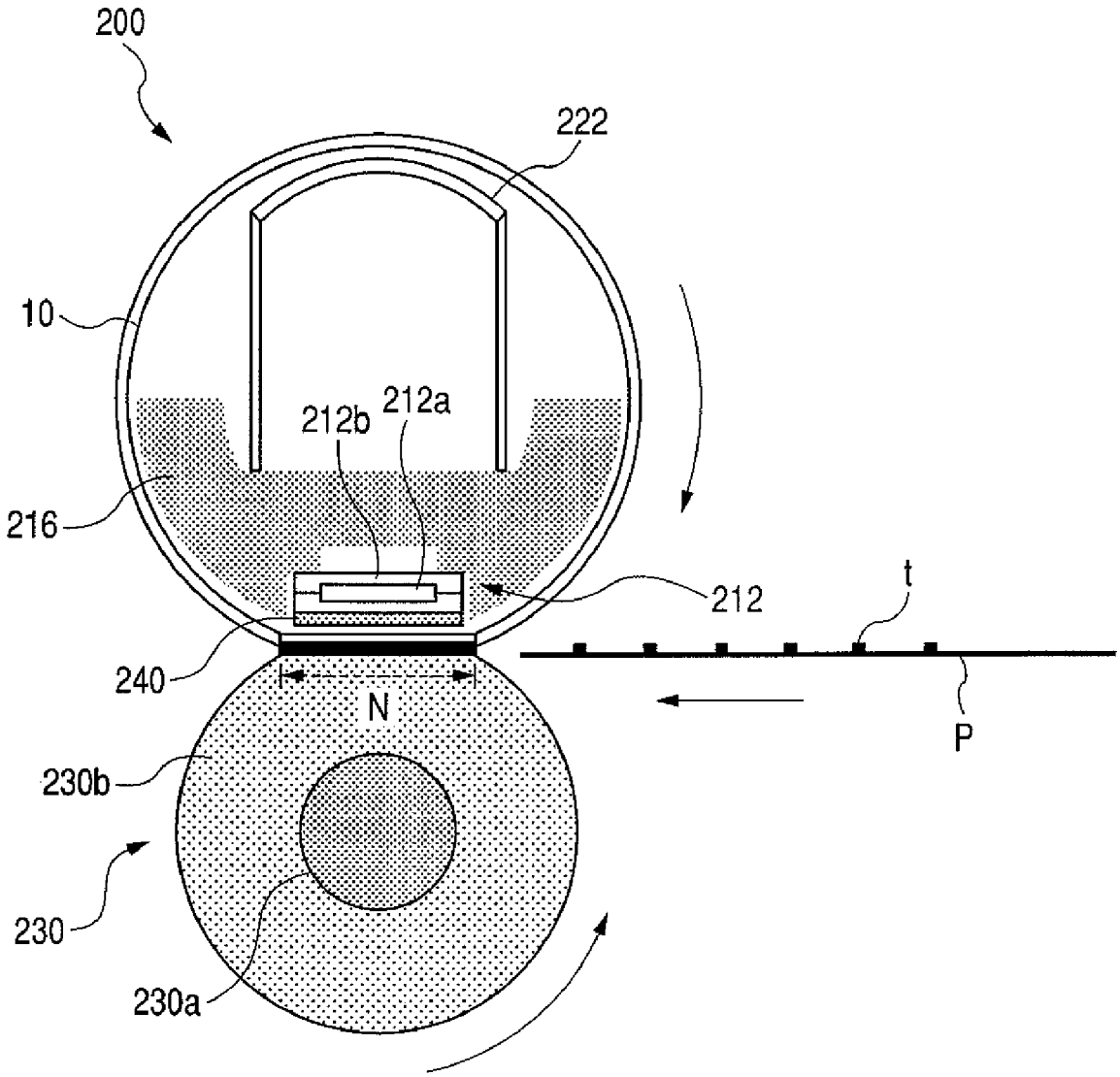
FIG. 3 is a schematic structural view showing an example of a heat fixing assembly.
Figure 4:
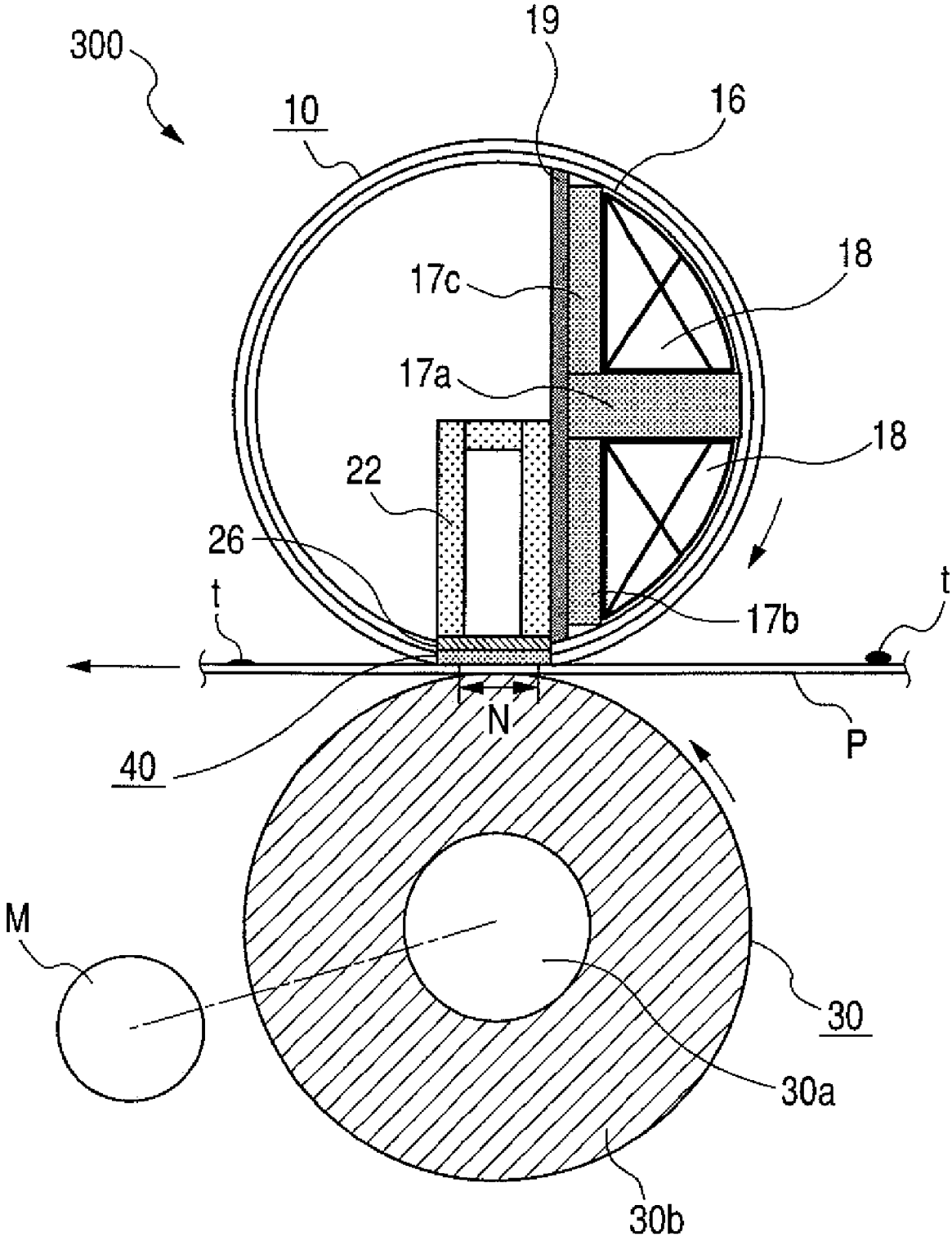
FIG. 4 is a schematic structural view showing another example of a heat fixing assembly.

The fixing belt 10 or 10' can have a sufficient physical and mechanical function in either of a case in which a ceramic heater is used (FIG. 3) and a case in which the fixing belt is used in an electromagnetic induction heating system (FIG. 4).

Belt Base Material 1

The endless metallic belt formed of a nickel alloy is used as the belt base material. Such an endless nickel alloy belt may be obtained by, e.g., immersing in an electroforming bath a columnar or cylindrical matrix (mold) made of stainless steel or the like, and forming a film on the outer surface or inner surface of the matrix by an electroforming process.

In commonly available plated metals, two types are known to exist in respect of solid solutions in which solute atoms stand dissolved in the matrix phase metal. They are what are called an interstitial solid solution and a substitutional solid solution. The former is a case in which solute atoms have very smaller atom diameter than matrix phase atom diameter as in the case of carbon, nitrogen or hydrogen atoms, and the solute atoms enter interstices between matrix phase atoms to make up the interstitial solid solution and make the matrix phase lattice strain strongly. On the other hand, in a case in which the difference in atomic diameter between solute atoms and matrix phase atoms is small, the solute atoms positionally replace a part of the matrix phase atoms to make up the substitutional solid solution.

Figure 5A:
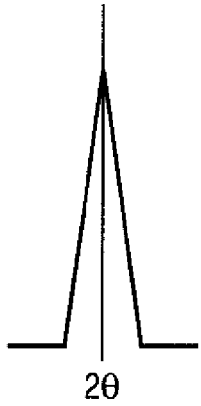
FIGS. 5A, 5B and 5C show changes in diffraction peaks in an X-ray diffraction pattern, caused by internal stress, where
Figure 5B:
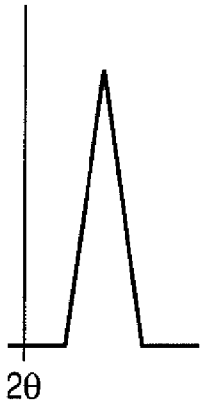
Figure 5C:
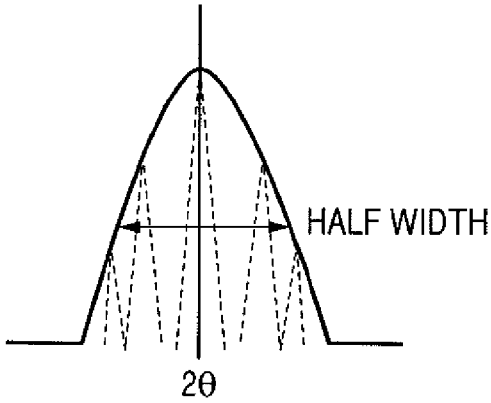

In respect of internal stress in the state of solid solution, two kinds are known to occur, which are the macroscopic stress due to a contractional or tensile state between matrix phase metallic lattices (i.e., matrix phase metallic lattice stress), and the microscopic stress due to a collection of solutes in microscopic regions. These states can be known from an X-ray diffraction pattern of the material. For example, FIG. 5A is a diagrammatic view of an X-ray diffraction pattern of the material. Where this is presented as a diffraction pattern in a case in which there occurs no internal stress, the macroscopic stress is observed where as shown in FIG. 5B, the X-ray diffraction pattern is positionally shifted to right or left. As also shown in FIG. 5C, the microscopic stress is observed where the half width of the X-ray diffraction pattern comes broad.

We the inventors have ever referred, in Japanese Patent Application Laid-open No. 2005-165921, to the relationship between microscopic stress and half width in the state of solid solution and the relationship between the microscopic stress and the durability of a fixing belt making use of an endless metallic belt made of a nickel alloy. The magnitude of microscopic stress is observable as a value of the half width, and this microscopic stress may be optimized to enable securement of the durability of the fixing belt. Then, the present inventors have reached a finding that a sufficient durability required as the fixing belt comes achievable in the case of an endless metallic belt made of a nickel alloy the half width in the state of solid solution of which has been controlled within a certain range.

However, in the case of commonly available electroformed nickel alloys, the microscopic stress has been unable to be optimized in the composition where a metallic element(s) other than nickel is or are in an amount of less than 5% by mass.

As a result of extensive studies made in order to make an improvement in this regard, they have found that the incorporation of a specific metal enables optimization of the microscopic stress even in the composition where the metallic element(s) other than nickel is or are in an amount of less than 5% by mass. Where the metallic element(s) other than nickel is/are in a content of as large as 5% by mass or more, the nickel alloy may have a low thermal conductivity depending on the metallic element(s) used, or, when used in the fixing assembly of a high-frequency electromagnetic induction heating system, a low electromagnetic induction efficiency may result. There has been such a problem.

The element(s) other than nickel that is/are to be contained in the endless metallic belt formed of a nickel alloy is/are a metalloid element(s), or an element(s) positioned in the vicinity of metalloid elements in the long form of the periodic table. The metalloid elements are substances intermediate between metallic elements and non-metallic elements, and exhibit metallic conduction, but have a lower electrical conductivity than usual metals. The elements (the group of first elements) usable in the present invention may specifically include phosphorus, boron, silicon, germanium, selenium, antimony, tellurium, bismuth and astatine. In the endless metallic belt of the present invention, at least one of these elements is contained. In particular, phosphorus and boron are preferred.

The addition of any element(s) included in the above group of first elements enables optimization of the microscopic stress even in the composition where the metallic element(s) other than nickel is or are in an amount of less than 5% by mass. Then, in an X-ray diffraction pattern of the nickel alloy, half widths of X-ray diffraction peaks of the (111) crystal plane and (200) crystal plane are both controlled to be from 0.5° to 2.5°, and more preferably from 0.5° to 2.0°, whereby a good durability comes achievable. The element(s) included in the above group of first elements may preferably be in a content of from 0.001% by mass to 12.000% by mass. Where the content is within the above range, the effect of optimizing the microscopic stress can be brought out to achieve a sufficient durability. In addition, the belt formed in a film can be kept from being not easily demolded from a stainless steel matrix (mold), so that the balance of stress in the film formed can be maintained, and the belt can be kept from the difficulty that it tends to break. Further, in order to control the process of electroforming, the above element(s) may more preferably be in a content of from 0.015% by mass to 10.000% by mass. Where the content is within this range, both good heat resistance and good flexing resistance can be achieved. The content may more preferably be from 0.015% by mass or more to 5.000% by mass, and particularly preferably be from 0.015% by mass to 3.000% by mass.

The endless metallic belt made of a nickel alloy may also be incorporated with an element(s) other than the nickel and the group of first elements, and may preferably be incorporated with iron. The iron may preferably be in a content of from 0.100% by mass to 60.000% by mass. Incorporation with iron within the above range enables the belt to maintain a good thermal conductivity.

The endless metallic belt made of a nickel alloy may also be incorporated with a further element(s) other than the nickel and the group of first elements, and may preferably be incorporated with a metallic element(s) selected from the group (second group of elements) consisting of cobalt, manganese, tungsten and molybdenum. The element(s) selected from the second group of elements may more preferably be cobalt from the viewpoint of magnetic properties and heat generation properties. The element(s) included in the second group of elements may preferably be in a content ranging from 0.100% by mass to 60.000% by mass. Where the content is within the above range, good wear resistance, flexing resistance and durability can be achieved, and also the internal stress of the belt can be well balanced to enable the belt to be kept from breaking. Further, from the viewpoint of controlling the process of electroforming, the content may more preferably be from 1.000% by mass to 50.000% by mass.

Where the thermal conductivity and the electromagnetic induction heating efficiency are taken into account, the element(s) included in the first group of elements and the element(s) included in the second group of elements may preferably be so controlled as to be 1.000% by mass or more to less than 5.000% by mass in total.

The nickel alloy endless metallic belt of the present invention may be produced by an electroforming process by using as the cathode a matrix (mold) made of, e.g., stainless steel. As an electroforming bath used here, any known nickel electroforming bath may be used, as exemplified by a nickel sulfamate bath or nickel sulfate bath to which other necessary metallic components have been added. Additives such as a pH adjuster, a pit preventive and a gloss agent may appropriately be added.

As the pH adjuster, sulfamic acid and sulfuric acid may be used; as the pit preventive, sodium laurate; as a stress reducer and a primary gloss agent, saccharin, saccharin sodium, sodium benzenesulfonate and sodium naphthalenesulfonate; and as a secondary gloss agent, butynediol, coumarin and diethyltriamine.

For example, the nickel electroforming bath may include, as basic bath composition, a bath containing from 400 to 650 g/liter of nickel sulfamate, from 0 to 60 g/liter of nickel chloride, from 20 to 50 g/liter of boric acid, from 0.01 to 2 g/liter of a surface-active agent sodium lauryl sulfate, from 5 to 300 mg/liter of the primary gloss agent saccharin, and from 10 to 1,000 mg/liter of the secondary gloss agent butynediol.

To co-precipitate the group of metallic elements other than nickel together with the nickel, any of cobalt sulfamate, cobalt sulfate, ferrous sulfate, manganese sulfamate, sodium tungstate and sodium molybdate may be added to the basic bath in an appropriate amount. Incidentally, the boric acid in the basic bath does not participate in the co-precipitation of boron.

To co-precipitate phosphorus together with nickel, a water-soluble phosphorus-containing acid may be added to the nickel electroforming bath in the form of a salt, as exemplified by sodium hypophosphite monohydrate, phosphorous acid and sodium phosphite. Boron may be co-precipitated together with nickel by adding to the nickel electroforming bath the boron in the form of a water-soluble organoboron compound as exemplified by tri(methyl)aminoborane.

Further, together with the adjustment of concentration of the respective components in the nickel electroforming bath, cathode current density, electroforming bath pH value, concentration of gloss agents to be added, electrolytic bath temperature and so forth may be controlled, whereby the nickel alloy belt is obtained which has the desired metal content and has the desired half widths of diffraction peaks.

Usually, the electroforming may preferably be carried out at a cathode current density of approximately from 1 to 30 $A/dm^2$, an electroforming bath pH value of approximately from 1 to 9 and an electrolytic bath temperature of approximately from 30 to 65° C., which may differ depending on the electrolytic bath used in the electroforming process.

The flexing resistance, heat resistance and durability of the electroformed nickel alloy belt are influenced by electroforming conditions (such as plating bath composition, current density, pH, stirring method and temperature). In addition to the controlling of electroforming nickel alloy bath composition, the current density and bath pH value of the electroforming process may be controlled, whereby other metallic elements can be co-precipitated together with nickel. In addition, it can be materialized that, in the X-ray diffraction pattern of the base material of the electroformed nickel alloy belt, the half widths of X-ray diffraction peaks of the (111) crystal plane and (200) crystal plane are both from 0.5° to 2.5°. Thus, the belt can have a high hardness and a high strength and at the same time can have superior flexing resistance and heat resistance. Even in the case of a small-diameter endless fixing belt required severely to have flexing resistance, the nickel alloy belt has so good flexing resistance that a high durability can surely be secured.

In order to make the belt base material have a small heat capacity to improve quick-start performance, it may preferably have a thickness of 10 μm or less, and preferably 10 μm or more from the viewpoint of manufacture.

Elastic Layer 2

The elastic layer is not necessarily required. However, by providing the elastic layer, the surface of the fixing belt releasing layer is improved in follow-up performance to the surfaces of unfixed toner images to enable conduction of heat in a good efficiency. The fixing belt provided with the elastic layer 2 is suitable especially for the heat-fixing of color toner images having a large quantity of unfixed toner borne on the recording medium.

The elastic layer 2 may be made of any material without any particular limitations. Materials having a good heat resistance and a good thermal conductivity may be selected. The elastic layer 2 may preferably be formed of silicone rubber, fluorine rubber, fluorosilicone rubber or the like, and particularly preferably silicone rubber.

The silicone rubber used in the elastic layer may be exemplified by polydimethylsiloxane, polymethyltrifluoropropylsiloxane, polymethylvinylsiloxane, polytrifluoropropylvinylsiloxane, polymethylphenylsiloxane, polyphenylvinylsiloxane, and copolymers of any of these polysilozxanes.

The elastic layer may optionally be incorporated with a reinforcing filler such as dry-process silica or wet-process silica, and any of calcium carbonate, quartz powder, zirconium silicate, clay (aluminum silicate), talc (hydrous magnesium silicate), alumina (aluminum oxide) and red iron oxide (iron(III) oxide).

The elastic layer 2 may preferably have a thickness of 10 μm or more (in particular, 50 μm or more) and preferably 1,000 μm or less (in particular, 500 μm or less), from the viewpoint of improving fixed-image quality. Where color images are printed, in particular, in the case of photographic images or the like, solid images are formed over a large area on a recording medium P. In such a case, heating non-uniformity may come about if the heating surface (releasing layer 3) can not follow up unevenness of the recording medium or unevenness of toner layers. This may cause heating non-uniformity and then gloss non-uniformity in images between areas having a high rate of heat transfer and areas having a low rate of heat transfer. That is, glossiness comes high at the areas having a high rate of heat transfer and glossiness comes low at the areas having a low rate of heat transfer. Where the elastic layer has a thickness within the above range, it can well follow-up the unevenness, so that any image gloss non-uniformity can be kept from coming about. Further, the elastic layer can have an appropriate heat resistance to enable achievement of quick start.

The elastic layer 2 may preferably have a hardness [JIS K 6253 (ISO 7619) 1993, enacted in 1993 in consistency with the international standard] of 60° C. or less, and particularly preferably 45° C. or less. In such a case, the image gloss non-uniformity can sufficiently be kept from coming about, and better fixed-image quality can be achieved.

The elastic layer 2 may preferably have a thermal conductivity λ of 0.25 W/m·K or more (in particular, 0.33 W/m·K or more) and preferably 2.00 W/m·K or less (in particular, 1.50 W/m·K or less). Where the elastic layer has a thermal conductivity λ within the above range, its hardness can be kept from becoming higher and its compression set can be kept from becoming poor, while maintaining the quickness of temperature rise in the surface layer (releasing layer 3) of the fixing belt.

Such an elastic layer may be formed by a known method, e.g. a method in which the metallic layer is coated thereon with a material such as liquid silicone rubber in a uniform thickness by a means such as blade coating, followed by heat curing; a method in which the material such as liquid silicone rubber is casted into a mold, followed by vulcanization curing; a method in which the material is shaped by extrusion, followed by vulcanization curing; or a method in which the material is injection-molded, followed by vulcanization curing.

Releasing Layer 3

The releasing layer 3 may be made of any material without any particular limitations. Materials having good releasability and heat resistance may be selected. The releasing layer 3 may preferably be formed of a fluorine resin such as PFA (tetrafluoroethylene/perfluoroalkyl ether copolymer), PTFE (polytetrafluoroethylene) or FEP (tetrafluoroethylene/hexafluoropropylene copolymer), a silicone resin, a fluorosilicone rubber, a fluorine rubber or a silicone rubber, and particularly preferably PFA. The releasing layer may optionally be further incorporated with a conducting agent such as carbon black or tin oxide within the range of 10% by mass or less of the releasing layer.

The releasing layer 3 may preferably have a thickness of 1 μm or more and preferably 100 μm or less. Where the releasing layer 3 have a thickness within the above range, both a sufficient durability and a good thermal conductivity can be achieved.

Such a releasing layer may be formed by a known method, e.g., in the case of a fluorine resin type, a method in which the belt base material or the elastic layer is coated thereon with a material made into a coating material by dispersing a fluorine resin powder, followed by drying or baking, or it is covered thereon with a material beforehand made into a tube and the former is bonded to the latter. In the case of a rubber type, the releasing layer may be formed by a method in which a liquid material is casted into a mold, followed by vulcanization curing; a method in which the material is shaped by extrusion, followed by vulcanization curing; or a method in which the material is injection-molded, followed by vulcanization curing.

A method may also be used in which a tube having previously been treated with a primer on its inner surface and a nickel belt having previously been treated with a primer on its outer surface are fitted in a cylindrical matrix (mold), and then liquid silicone rubber is injected into a gap between the tube and the nickel belt, followed by curing to bond the rubber. This enables simultaneous formation of the elastic layer and the releasing layer.

The fixing belt may be provided on its sliding surface with a sliding layer formed of polyimide or the like, which is not necessarily required.

The heat fixing assembly of the present invention is described next.

FIG. 3 is a sectional diagrammatic view showing an example of a heat fixing assembly 200. In this example, the heat fixing assembly 200 is an assembly of a belt heating system making use of a ceramic heater as a heating element. A fixing belt 10 is that of the present invention, described above. It is preferable for the fixing belt to have an inner diameter of 30 mm or less, in order to make the assembly compact.

A belt guide 216 is a heat-resistant and heat-insulating belt guide. The ceramic heater 212 as a heating element is inserted to a groove formed and provided along the long dimension of the belt guide 216 at its substantially middle portion on the bottom surface so as to be stationarily supported therein. Then, the fixing belt 10 of the present invention, which is cylindrical or endless, is loosely externally fitted to the belt guide 216.

A pressuring rigid stay 222 is inserted to the inside of the belt guide 216.

A pressuring member 230 is an elastic pressure roller in this example. This pressure roller 230 has a mandrel **230*a* and provided thereon an elastic layer 230*b* formed of silicone rubber or the like so as to have a low hardness. It is so provided that both end portions of its mandrel 230*a* are rotatably supported with bearings between chassis's side plates on this side and back side (not shown) of the assembly. In order to improve surface properties, the elastic pressure roller 230** may further be provided on its outer periphery with a fluorine resin layer formed of PTFE (polytetrafluoroethylene) PFA (tetrafluoroethylene/perfluoroalkyl ether copolymer) or FEP (tetrafluoroethylene/hexafluoropropylene copolymer).

Both end portions of the pressuring rigid stay 222 and a spring bearing member (not shown) on the chassis side of the assembly may respectively be provided between them with pressure springs (not shown) in a compressed state so that a press-down force may be made to act on the pressuring rigid stay 222. Thus, the bottom surface of a sliding plate 240 of the ceramic heater 212 provided on the bottom surface of the belt guide member 216 and the top surface of the pressure roller 230 come into pressure contact with each other holding the fixing belt 10 between them, to form a fixing nip zone N in a stated width. Here, as a material for the belt guide member 216, it is preferable to use heat-resistant phenolic resin, LCP (liquid-crystal polyester) resin, PPS (polyphenylene sulfide) resin or PEEK (polyether ether ketone) resin, which is a resin having an excellent heat resistance.

The pressure roller 230 is rotatingly driven by a drive means in the counterclockwise direction as shown by an arrow. In virtue of the frictional force produced between the pressure roller 230 and the outer surface of the fixing belt 10 produced by the rotational drive of the pressure roller 230, a rotational force acts on the fixing belt 10. Thus, the fixing belt 10 is rotated along the outer surface of the belt guide 216 in the clockwise direction as shown by an arrow and at a peripheral speed corresponding substantially to the rotational peripheral speed of the pressure roller 230 while sliding, at its inner surface, in close contact with the bottom surface of the ceramic heater 212 at the fixing nip zone N (a pressure roller drive system).

The pressure roller 230 starts to be rotated in accordance with print start signals, and also the ceramic heater 212 starts to be heated up. In the state the peripheral speed of the fixing belt 10 rotated by the rotation of the pressure roller 230 has become constant and the temperature of the ceramic heater 212 has risen to a stated temperature, a recording medium P holding thereon toner images t as a material to be heated is guided in between the fixing belt 10 and the pressure roller 230 at the fixing nip zone N, with the toner image holding surface side on the fixing belt 10 side. Then, the recording medium P comes close contact with the bottom surface of the ceramic heater 212 via the fixing belt 10 at the fixing nip zone N, where it moves on to pass through the fixing nip zone N together with the fixing belt 10. In the course it moves to pass there, the heat of the ceramic heater 212 is imparted to the recording medium P via the fixing belt 10, so that the toner images t are heat-fixed to the surface of the recording medium P. The recording medium P having passed through the fixing nip zone N is separated from the outer surface of the fixing belt 10 and transported on.

The ceramic heater 212 as a heating element is a low-heat capacity, oblong and linear heating element which extends lengthwise in the direction crossing at right angles the direction of movement of the fixing belt 10 and recording medium P. It is basically constituted of a heater substrate made of aluminum nitride or the like, a heat generation layer 212*a* (e.g., a layer provided by coating with an electrically resistant material such as Ag/Pd (silver/palladium) by screen printing or the like in a thickness of about 10 μm and a width of from 1 to 5 mm) provided on the surface of this heater substrate along its long dimension, and further provided thereon a protective layer 212*b* formed of glass, fluorine resin or the like. The ceramic heater used is by no means limited to the one described above.

Then, upon electrification across both ends of the heat generation layer 212*a* of the ceramic heater 212, the heat generation layer 212*a* generates heat and the temperature of the ceramic heater 212 rises quickly. This heater temperature is detected with a temperature sensor (not shown), and the electrification to the heat generation layer 212*a* is controlled by a control circuit (not shown) so that the heater temperature can be maintained at a stated temperature. Thus, the ceramic heater 212 is temperature-controlled.

The ceramic heater 212 is stationarily supported therein in the state, as described previously, it is inserted with its protective layer 212*b* side upward, to the groove formed and provided along the long dimension of the belt guide 216 at substantially the middle thereof on its bottom surface. At the fixing nip zone N where the ceramic heater 212 comes into contact with the fixing belt 10, the surface of the sliding plate 240 of the ceramic heater 212 and the inner surface of the fixing belt 10 slide mutually in contact with each other. Nip width is changed correspondingly to the process speed in order to secure the time for which the recording paper stays at the nip zone. The nip width may preferably be set to be 5 mm or more with respect to a process speed of 100 mm/sec or more.

The endless metallic belt of the present invention and the fixing belt making use of the same are also adaptable to an electromagnetic induction heat fixing assembly like that shown in FIG. 4.

FIG. 4 is a sectional schematic diagrammatic view showing another embodiment of the heat fixing assembly of the present invention. A heat fixing assembly 300 is a heat fixing assembly of an electromagnetic-induction heating type belt heating system, and a fixing belt 10 is the above fixing belt of the present invention.

In the heat fixing assembly 300, a magnetic-field generation means consists basically of magnetic cores 17*a*, 17*b* and 17*c* and an exciting coil 18.

The magnetic cores 17*a* to 17*c* are members having high permeability, and may preferably be those formed of materials used in cores of transformers, such as ferrite and Permalloy. In particular, it is preferable to use ferrite, which may cause less loss even at 100 kHz or more.

In the exciting coil 18, a bundle of a plurality of small-gauge wires (i.e., a bundled cable) made of copper individual wires of which have each been one by one insulation-coated is used as a conductor wire (electric wire) constituting a coil. This is turned a plurality of times to form an exciting coil. In this embodiment, eleven (11) turns of the bundled cable form the exciting coil 18.

As insulation coatings, coatings having heat resistance may preferably be used taking account of the heat conduction attributable to the heat generation of the fixing belt 10. For example, coatings formed of polyimide resin may be used. Here, a pressure may be applied from the outside of the exciting coil 18 to improve its closeness.

An insulating member 19 is provided between the magnetic-field generation means and a pressuring rigid stay 222. As materials for the insulating member 19, those having excellent insulating properties and excellent heat resistance may be used. For example, they may preferably include phenolic resins, fluorine resins, polyimide resins, polyamide resins, poly(amide-imide) resins, PEEK (polyether ether ketone) resins, PES (polyether sulfone) resins, PPS (polyphenylene sulfide) resins, PFA (tetrafluoroethylene/perfluoroalkyl ether copolymer) resins, PTFE (polytetrafluoroethylene) resins and FEP (tetrafluoroethylene/hexafluoropropylene copolymer) resins and LCP (liquid-crystal polyester) resins.

An excitation circuit (not shown) is connected to the exciting coil 18 at its electricity feeding terminals (not shown). This excitation circuit (not shown) may preferably be one which is so made that a high-frequency power of from 20 kHz to 500 kHz can be produced by a switching power source. The exciting coil 18 generates alternating magnetic flux upon application of alternating current (high-frequency current) from the excitation circuit (not shown).

The alternating magnetic flux guided to the magnetic cores 17*a* to 17*c* causes the metallic belt layer (electromagnetic-induction heat generation layer) (reference numeral 1 in FIGS. 1 and 2) to produce eddy currents. The eddy currents cause the metallic belt layer (electromagnetic-induction heat generation layer) 1 to produce Joule heat (eddy current loss) in virtue of the specific resistance of the metallic belt layer (electromagnetic-induction heat generation layer) 1. Heat generation quantity Q here depends on the density of magnetic flux passing through the metallic belt layer (electromagnetic-induction heat generation layer) 1. The temperature at a fixing nip zone N is so temperature-controlled that a stated value can be maintained by controlling the feeding of electric current to the exciting coil 18 by means of a temperature control system having a temperature detection means (not shown). In the embodiment shown in FIG. 4, a temperature sensor 26 is a thermistor or the like which detects the temperature of the fixing belt 10. It is so set that the temperature of the fixing nip zone N can be controlled on the basis of the temperature information of the fixing belt 10, obtained by measurement with the temperature sensor 26.

A pressure roller 30 as a pressuring member is constituted of a mandrel 30*a* and an elastic layer 30*b* formed of a heat-resistant elastic material such as silicone rubber, fluorine rubber, fluorine resin with which the periphery of the mandrel is covered in a concentrically integral form by molding in the shape of a roller. The pressure roller 30 is so provided that both end portions of the mandrel 30*a* are rotatably supported on bearings between side plates on the side of chassis (not shown) of the assembly.

Between both ends of the pressuring rigid stay 22 and spring bearing members (not shown) on the chassis side of the assembly, pressure springs (not shown) are respectively provided in a compressed state so that a press-down force acts on the pressuring rigid stay 22. Thus, the bottom surface of a sliding plate 40 provided at the bottom surface of a belt guide member 16 and the top surface of the pressure roller 30 come into pressure contact holding the fixing belt 10 between them to form the fixing nip zone N in a stated width. Here, as the belt guide member 16, it is preferable to use one formed of a resin having excellent heat resistance, such as heat-resistant phenolic resin, LCP (liquid-crystal polyester) resin, PPS (polyphenylene sulfide) resin or PEEK (polyether ether ketone) resin.

The pressure roller 30 is rotatingly driven by a drive means M in the counterclockwise direction as shown by an arrow. In virtue of a frictional force produced between the pressure roller 30 and the outer surface of the fixing belt 10 by the rotational drive of the pressure roller 30, a rotational force acts on the fixing belt 10. Thus, the fixing belt 10 is rotated along the outer surface of the belt guide member 16 in the clockwise direction as shown by an arrow and at a peripheral speed corresponding substantially to the rotational speed of the pressure roller 30 while sliding, at its inner surface, on the bottom surface of the sliding plate 40 at the fixing nip zone N.

In this way, the pressure roller 30 is rotatingly driven and, with its rotation, the fixing belt 10 is rotated, where the electromagnetic-induction heat generation of the fixing belt 10 is effected as described above, by supplying electricity to the exciting coil 18 from the excitation circuit (not shown). In the state the temperature of the fixing nip zone N has risen to the stated temperature while being temperature-controlled, a recording medium P transported from an image-forming means section and on which unfixed toner images t have been formed is guided to the part between the fixing belt 10 and the pressure roller 30 at the fixing nip zone N with the image surface of the recording medium upside, i.e., facing the outer surface of the fixing belt 10. Then, at the fixing nip zone N, the image surface comes into close contact with the outer surface of the fixing belt 10, where the recording medium P is sandwichedly transported on through the fixing nip zone N together with the fixing belt 10. In this course, the unfixed toner images t are heated by the electromagnetic-induction heat generation of the fixing belt 10, and heat-fixed to the surface of the recording medium P. The recording medium P having passed through the fixing nip zone N is separated from the outer surface of the rotating fixing belt 10, and transported on until it is put out.

The heat-fixed toner images on the recording medium become cool after they have passed through the fixing nip zone N, and turn into permanent fixed images. In this embodiment, the heat fixing assembly is not provided with any oil application mechanism for preventing offset. Such an oil application mechanism may be provided when a toner not incorporated with any low-softening substance is used. Also when a toner incorporated with a low-softening substance is used, the recording medium P may be separated under application of oil and with cooling.

The pressuring member may also be, without limitation to the member having the shape of a roller like the pressure roller 30, a member of other form such as a rotatingly movable film type. In order to feed heat energy to the recording medium P also from the pressure roller 30 side, a heat generation means of the electromagnetic-induction heating system or the like may also be provided on the pressure roller 30 side so that it can be so constructed as to be heated and temperature-controlled to the stated temperature.

In the present invention, the nickel and the iron and other metallic elements (second group of elements) in the endless metallic belt (belt base material) are quantitatively analyzed with an RIX3000 model, fluorescent X-ray analyzer manufactured by Rigaku International Corporation. Other trace elements (first group of elements) in the endless metallic belt (belt base material) are quantitatively analyzed with an inductively coupled plasma emission analyzer (ICP Vista-PRO) manufactured by Seiko Instruments Inc.

The X-ray diffraction pattern of the endless metallic belt (belt base material) is measured with an X-ray diffraction instrument (an RINT2000 model, X-ray diffraction instrument manufactured by Rigaku International Corporation; wavelength: 1.54059 angstroms) to obtain the half widths of X-ray diffraction peaks from the analysis of the diffraction patterns.

EXAMPLE

The present invention is described below in greater detail by giving Examples and Comparative Examples.

Example 1

| | |
|---|---|
| Nickel sulfate hexahydrate | 140.000 g |
| Ferrous sulfate | 0.200 g |
| Boric acid | 30.000 g |
| Sodium chloride | 25.000 g |
| Stress reducer (saccharin sodium) | 0.300 g |
| Pit preventive (sodium lauryl sulfate) | 0.020 g |
| Sodium phosphite hydrate | 0.100 g |

An aqueous solution (electroforming nickel alloy bath) containing the above compounds per 1 liter of the aqueous solution was prepared. Then, setting as the cathode a matrix (mold) made of stainless steel, a film was formed on the surface of the matrix while controlling bath temperature at 50° C., pH at 2.6 and current density at 6 A/dm$^2$, to produce an electroformed nickel alloy belt base material. The electroformed nickel alloy belt base material (endless nickel alloy belt) thus obtained was 400 mm in outer peripheral length, 30 mm in inner diameter and 30 μm in wall thickness and had composition of Ni(99.85% by mass)–Fe(0.10% by mass)–P (0.05% by mass). The half widths of diffraction peaks of the (111) crystal plane and (200) crystal plane in its X-ray diffraction pattern were 0.50 and 0.60, respectively.

On the electroformed nickel alloy belt base material, a silicone rubber layer of 300 μm thick and a PFA tube of 30 μm thick were further layered as the elastic layer 2 and the releasing layer 3, respectively, via primer layers to obtain a fixing belt constituted as shown in FIG. 1.

Example 2

An electroformed nickel alloy belt base material was produced in the same manner as that in Example 1 except that the amount of the sodium phosphite hydrate was changed to 1.500 g. The electroformed nickel alloy belt base material (endless nickel alloy belt) thus obtained had composition of Ni(97.90% by mass)–Fe(0.10% by mass)–P(2.00% by mass).

Using the electroformed nickel alloy belt base material obtained, a fixing belt was obtained in the same way as that in Example 1.

Example 3

An electroformed nickel alloy belt base material was produced in the same manner as that in Example 1 except that the amount of the ferrous sulfate was changed to 4.000 g and 0.150 g of tri(methyl)aminoborane was used in place of the sodium phosphite hydrate. The electroformed nickel alloy belt base material (endless nickel alloy belt) thus obtained had composition of Ni(96.90% by mass)–Fe(3.00% by mass)–B (0.10% by mass).

Using the electroformed nickel alloy belt base material obtained, a fixing belt was obtained in the same way as that in Example 1.

Example 4

An electroformed nickel alloy belt base material was produced in the same manner as that in Example 1 except that the amount of the ferrous sulfate was changed to 15.000 g and also the amount of the sodium phosphite hydrate was changed to 0.400 g. The electroformed nickel alloy belt base material (endless nickel alloy belt) thus obtained had composition of Ni(78.50% by mass)–Fe(20.00% by mass)–P(1.50% by mass).

Using the electroformed nickel alloy belt base material obtained, a fixing belt was obtained in the same way as that in Example 1.

Example 5

An electroformed nickel alloy belt base material was produced in the same manner as that in Example 1 except that the amount of the ferrous sulfate was changed to 20.000 g and 0.050 g of tri(methyl)aminoborane was used in place of the sodium phosphite hydrate. The electroformed nickel alloy belt base material (endless nickel alloy belt) thus obtained had composition of Ni(54.95% by mass)–Fe(45.00% by mass)–B(0.05% by mass).

Using the electroformed nickel alloy belt base material obtained, a fixing belt was obtained in the same way as that in Example 1.

Example 6

| | |
|---|---|
| Nickel sulfamate | 450.000 g |
| Cobalt sulfamate | 7.500 g |
| Boric acid | 30.000 g |
| Nickel chloride | 28.000 g |
| Stress reducer (saccharin sodium) | 0.030 g |
| Secondary gloss agent (butynediol) | 0.300 g |
| Pit preventive (sodium lauryl sulfate) | 0.020 g |
| Sodium phosphite hydrate | 0.400 g |

An aqueous solution (electroforming nickel alloy bath) containing the above compounds per 1 liter of the aqueous solution was prepared. Then, setting as the cathode a matrix (mold) made of stainless steel, a film was formed on the surface of the matrix while controlling bath temperature at 50° C., pH at 2.6 and current density at 10 A/dm$^2$, to produce an electroformed nickel alloy belt base material. The electroformed nickel alloy belt base material (endless nickel alloy belt) thus obtained had composition of Ni(96.50% by mass)–Co(3.00% by mass)–P(0.50% by mass).

Using the electroformed nickel alloy belt base material obtained, a fixing belt was obtained in the same way as that in Example 1.

Example 7

| | |
|---|---|
| Nickel sulfamate | 450.000 g |
| Manganese sulfamate | 90.000 g |
| Boric acid | 30.000 g |
| Nickel chloride | 25.000 g |
| Stress reducer (saccharin sodium) | 0.030 g |
| Secondary gloss agent (butynediol) | 0.300 g |
| Pit preventive (sodium lauryl sulfate) | 0.020 g |
| Sodium phosphite hydrate | 0.400 g |

An aqueous solution (electroforming nickel alloy bath) containing the above compounds per 1 liter of the aqueous solution was prepared. Then, setting as the cathode a matrix (mold) made of stainless steel, a film was formed on the surface of the matrix while controlling bath temperature at 50° C., pH at 2.6 and current density at 10 A/dm$^2$, to produce an electroformed nickel alloy belt base material. The electroformed nickel alloy belt base material (endless nickel alloy belt) thus obtained had composition of Ni(98.50% by mass)–Mn(1.00% by mass)–P(0.50% by mass).

Using the electroformed nickel alloy belt base material obtained, a fixing belt was obtained in the same way as that in Example 1.

Example 8

| | |
|---|---|
| Nickel sulfate hexahydrate | 60.000 g |
| Tungsten sulfate dihydrate | 3.500 g |
| Boric acid | 30.000 g |
| Sodium chloride | 25.000 g |
| Citric acid | 36.700 g |
| Stress reducer (saccharin sodium) | 0.300 g |
| Pit preventive (sodium lauryl sulfate) | 0.020 g |
| Sodium phosphite hydrate | 0.400 g |

An aqueous solution (electroforming nickel alloy bath) containing the above compounds per 1 liter of the aqueous solution was prepared. Then, setting as the cathode a matrix (mold) made of stainless steel, a film was formed on the surface of the matrix while controlling bath temperature at 65° C., pH at 2.0 and current density at 5 A/dm$^2$, to produce an electroformed nickel alloy belt base material. The electroformed nickel alloy belt base material (endless nickel alloy belt) thus obtained had composition of Ni(96.50% by mass)–W(3.00% by mass)–P(0.50% by mass).

Using the electroformed nickel alloy belt base material obtained, a fixing belt was obtained in the same way as that in Example 1.

Example 9

An electroformed nickel alloy belt base material was produced in the same manner as that in Example 1 except that the amount of the ferrous sulfate was changed to 2.00 g and 0.50 g of bismuth methanesulfonate was used in place of the sodium phosphite hydrate. The electroformed nickel alloy belt base material (endless nickel alloy belt) thus obtained had composition of Ni(96.50% by mass)–Fe(3.00% by mass)–Bi (0.50% by mass).

Using the electroformed nickel alloy belt base material obtained, a fixing belt was obtained in the same way as that in Example 1.

Example 10

| | |
|---|---|
| Nickel sulfate hexahydrate | 47.800 g |
| Sodium molybdate dihydrate | 3.630 g |
| Sodium citrate | 82.240 g |
| Boric acid | 30.000 g |
| Sodium chloride | 25.000 g |
| Stress reducer (saccharin sodium) | 0.100 g |
| Pit preventive (sodium dodecyl sulfate) | 0.010 g |
| Sodium phosphite hydrate | 0.400 g |

An aqueous solution (electroforming nickel alloy bath) containing the above compounds per 1 liter of the aqueous solution was prepared. Then, setting as the cathode a matrix (mold) made of stainless steel, a film was formed on the surface of the matrix while controlling bath temperature at 40° C., pH at 5.0 and current density at 8 A/dm$^2$, to produce an electroformed nickel alloy belt base material. The electroformed nickel alloy belt base material (endless nickel alloy belt) thus obtained had composition of Ni(96.50% by mass)–Mo(3.00% by mass)–P(0.50% by mass).

Using the electroformed nickel alloy belt base material obtained, a fixing belt was obtained in the same way as that in Example 1.

Comparative Example 1

| | |
|---|---|
| Nickel sulfate hexahydrate | 140.000 g |
| Ferrous sulfate | 2.000 g |
| Boric acid | 30.000 g |
| Sodium chloride | 25.000 g |
| Stress reducer (saccharin sodium) | 0.300 g |
| Pit preventive (sodium lauryl sulfate) | 0.020 g |

An aqueous solution (electroforming nickel alloy bath) containing the above compounds per 1 liter of the aqueous solution was prepared. Then, setting as the cathode a matrix (mold) made of stainless steel, a film was formed on the surface of the matrix while controlling bath temperature at 50° C., pH at 3.8 and current density at 6 A/dm$^2$, to produce an electroformed nickel alloy belt base material. The electroformed nickel alloy belt base material (endless nickel alloy belt) thus obtained was 400 mm in outer peripheral length, 30 mm in inner diameter and 30 μm in wall thickness and had composition of Ni(99.00% by mass)–Fe(1.00% by mass).

Using the electroformed nickel alloy belt base material obtained, a fixing belt was obtained in the same way as that in Example 1.

Comparative Example 2

| | |
|---|---|
| Nickel sulfamate | 450.000 g |
| Cobalt sulfamate | 75.000 g |
| Nickel bromide | 14.000 g |
| Boric acid | 30.000 g |
| Nickel chloride | 28.000 g |
| Stress reducer (saccharin sodium) | 0.030 g |
| Secondary gloss agent (butynediol) | 0.300 g |
| Pit preventive (sodium lauryl sulfate) | 0.020 g |
| Sodium phosphite hydrate | 14.000 g |

An aqueous solution (electroforming nickel alloy bath) containing the above compounds per 1 liter of the aqueous solution was prepared. Then, setting as the cathode a matrix (mold) made of stainless steel, a film was formed on the surface of the matrix while controlling bath temperature at 50° C., pH at 4 and current density at 2 A/dm$^2$, to produce an electroformed nickel alloy belt base material. The electroformed nickel alloy belt base material (endless nickel alloy belt) thus obtained had composition of Ni(34.00% by mass)–Co(50.00% by mass)–P(16.00% by mass).

Using the electroformed nickel alloy belt base material obtained, a fixing belt was obtained in the same way as that in Example 1.

Comparative Example 3

| | |
|---|---|
| Nickel sulfamate | 450.000 g |
| Cobalt sulfamate | 2.000 g |
| Nickel bromide | 9.000 g |
| Boric acid | 30.000 g |
| Nickel chloride | 28.000 g |
| Stress reducer (saccharin sodium) | 0.030 g |
| Secondary gloss agent (butynediol) | 0.300 g |
| Pit preventive (sodium lauryl sulfate) | 0.020 g |
| Sodium phosphite hydrate | 0.0500 g |

An aqueous solution (electroforming nickel alloy bath) containing the above compounds per 1 liter of the aqueous solution was prepared. Then, setting as the cathode a matrix (mold) made of stainless steel, a film was formed on the surface of the matrix while controlling bath temperature at 50° C., pH at 4 and current density at 10 A/dm$^2$, to produce an electroformed nickel alloy belt base material. The electroformed nickel alloy belt base material (endless nickel alloy belt) thus obtained had composition of Ni(98.09% by mass)–Co(1.00% by mass)–P(0.01% by mass).

Using the electroformed nickel alloy belt base material obtained, a fixing belt was obtained in the same way as that in Example 1.

Comparative Example 4

| | |
|---|---|
| Nickel sulfamate | 450.000 g |
| Cobalt sulfamate | 0.500 g |
| Boric acid | 30.000 g |
| Nickel chloride | 20.000 g |
| Stress reducer (saccharin sodium) | 0.025 g |
| Secondary gloss agent (butynediol) | 0.300 g |
| Pit preventive (sodium lauryl sulfate) | 0.500 g |
| Bismuth methanesulfonate | 0.500 g |

An aqueous solution (electroforming nickel alloy bath) containing the above compounds per 1 liter of the aqueous solution was prepared. Then, setting as the cathode a matrix (mold) made of stainless steel, a film was formed on the surface of the matrix while controlling bath temperature at 50° C., pH at 4.0 and current density at 10 A/dm$^2$, to produce an electroformed nickel alloy belt base material. The electroformed nickel alloy belt base material (endless nickel alloy belt) thus obtained had composition of Ni(99.00% by mass)–Co(0.50% by mass)–Bi(0.50% by mass).

Using the electroformed nickel alloy belt base material obtained, a fixing belt was obtained in the same way as that in Example 1.

Blank-Rotation Experiment

First, the fixing belts produced in Examples 1 to 10 and Comparative Examples 1 to 4 were fitted in fixing assemblies each constructed as shown in FIG. 3, and blank-rotation experiments were conducted under conditions shown below.

To conduct blank-rotation running tests, the pressure roller was pressed against the fixing belt at a stated pressuring force to make the fixing belt rotated in follow-up to the pressure roller. The pressure roller used was a rubber roller of 30 mm in outer diameter and having a silicone layer of 3 mm in wall thickness which was covered with a 30 μm thick PFA tube. In the present experiment, conditions were so set that the pressuring force was 200 N, the fixing nip was 8 mm×230 mm in area and the surface speed of the fixing belt was 100 mm/sec. The fixing belts were each put to the above rotation test, where the time by which each belt came cracked or broken was regarded as running time.

In the nickel-iron-phosphorus (or boron) alloys in Examples 1 to 5, the content of phosphorus or boron was adjusted in accordance with the content of the iron that was a metal other than the nickel. This enabled securement of 0.5° or more of half widths of X-ray diffraction peaks of the (111) crystal plane and (200) crystal plane in the X-ray diffraction pattern. The fixing belts in which the endless metallic belts containing such alloys were used as belt base materials were able to achieve 500 hours or more of running time.

In the nickel-cobalt(or manganese or tungsten)-phosphorus alloys in Examples 6 to 8, even though the cobalt, manganese or tungsten was in a small content, the phosphorus was incorporated in an amount of 0.50% by mass. This enabled securement of 0.5° or more of half widths of X-ray diffraction peaks of the (111) crystal plane and (200) crystal plane in the X-ray diffraction pattern. The fixing belts in which the endless metallic belts containing such alloys were used as belt base materials were able to achieve 500 hours or more of running time.

In Example 9, bismuth was added to the nickel-iron alloy. This also enabled securement of 0.5° or more of half widths of X-ray diffraction peaks of the (111) crystal plane and (200) crystal plane in the X-ray diffraction pattern. The fixing belt in which the endless metallic belt containing such an alloy was used as a belt base material were able to achieve 500 hours or more of running time.

In Example 10, the metal other than nickel was changed to molybdenum, but phosphorus was incorporated in an amount of 0.50% by mass. This also enabled securement of 0.5° or more of half widths of X-ray diffraction peaks of the (111) crystal plane and (200) crystal plane in the X-ray diffraction pattern. The fixing belt in which the endless metallic belt containing such an alloy was used as a belt base material were able to achieve 500 hours or more of running time.

Comparative Example 1 is an example making use of an alloy in which nickel was incorporated with 1.00% by mass of iron and the element specified in the present invention was not added. This resulted in less than 0.5° of half widths of X-ray diffraction peaks of the (111) crystal plane and (200) crystal plane in the X-ray diffraction pattern. In the fixing belt in which the endless metallic belt containing such an alloy was used as a belt base material, the running time was 240 hours.

Comparative Example 2 is an example making use of an alloy in which nickel was incorporated with 50.00% by mass of cobalt and 16.00% by mass of phosphorus. This resulted in more than 2.5° of half widths of X-ray diffraction peaks of the (111) crystal plane and (200) crystal plane in the X-ray diffraction pattern. In the fixing belt in which the endless metallic belt containing such an alloy was used as a belt base material, the running time was 150 hours.

Comparative Example 3 is an example in which nickel was incorporated with 1.00% by mass of cobalt and 0.01% by mass of phosphorus. This resulted in less than 0.5° of half widths of X-ray diffraction peaks of the (111) crystal plane and (200) crystal plane in the X-ray diffraction pattern. In the fixing belt in which the endless metallic belt containing such an alloy was used as a belt base material, the running time was 200 hours.

Comparative Example 4 is an example in which nickel was incorporated with 0.50% by mass of cobalt and 0.50% by mass of phosphorus. This resulted in less than 0.5° of half widths of X-ray diffraction peaks of the (111) crystal plane and (200) crystal plane in the X-ray diffraction pattern. In the fixing belt in which the endless metallic belt containing such an alloy was used as a belt base material, the running time was 350 hours.

TABLE 1

| | Alloy composition | Half widths of diffraction peaks of: (111) crystal plane (deg) | (200) Crystal plane (deg) | Endless metallic belt thickness (μm) | Running time (hr) |
|---|---|---|---|---|---|
| Examp. 1 | Ni—0.10% Fe—0.05% P | 0.50 | 0.60 | 30 | 550 |
| Examp. 2 | Ni—0.10% Fe—2.00% P | 0.65 | 0.98 | 30 | 650 |
| Examp. 3 | Ni—3.00% Fe—0.10% B | 0.75 | 1.10 | 30 | 650 |
| Examp. 4 | Ni—20.00% Fe—1.50% P | 1.35 | 2.50 | 30 | 980 |
| Examp. 5 | Ni—45.00% Fe—0.05% B | 1.05 | 1.35 | 30 | 800 |
| Examp. 6 | Ni—3.00% Co—0.50% P | 0.60 | 0.93 | 30 | 650 |
| Examp. 7 | Ni—1.00% Mn—0.50% P | 0.65 | 0.98 | 30 | 630 |
| Examp. 8 | Ni—3.00% W—0.50% P | 0.68 | 1.01 | 30 | 650 |
| Examp. 9 | Ni—3.00% Fe—0.50% Bi | 0.72 | 1.05 | 30 | 670 |
| Examp. 10 | Ni—3.00% Mo—0.50% P | 0.55 | 0.85 | 30 | 780 |
| Comp. Examp. 1 | Ni—1.00% Fe | 0.34 | 0.45 | 30 | 240 |
| Comp. Examp. 2 | Ni—50.00% Co—16.00% P | 2.60 | 3.00 | 30 | 150 |
| Comp. Examp. 3 | Ni—1.00% Co—0.01% P | 0.34 | 0.40 | 30 | 200 |
| Comp. Examp. 4 | Ni—0.50% Co—0.50% Bi | 0.40 | 0.46 | 30 | 350 |

Running Paper Feed Experiment

The above fixing assemblies were each set in a full-color laser beam printer LBP2040 (manufactured by CANON INC.), and a image reproduction test on 100,000-sheet running was conducted, setting the pressuring force at 200 N, the fixing nip to 8 mm×230 mm in area and the process speed at 100 mm/sec. Here, 0.9 g of grease (HP300, available from Dow Corning Asia Co., Ltd.) was applied to the inner surface of each fixing belt.

Those making use of the fixing belts of Examples 1 to 10 were able to finish the image reproduction test on 100,000-sheet running, without any trouble.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-078358, filed Mar. 22, 2006, which is hereby incorporated by reference herein in its entirety.

What is claimed is:

1. An endless metallic belt which comprises a nickel alloy;

the nickel alloy containing at least one element selected from the first group of elements consisting of phosphorus, boron, silicon, germanium, selenium, antimony, tellurium, bismuth and astatine, and, in an X-ray diffraction pattern of which, half widths of X-ray diffraction peaks of the (111) crystal plane and (200) crystal plane are both from 0.5° to 2.5°.

2. The endless metallic belt according to claim 1, wherein the element selected from the first group of elements is phosphorus or boron.

3. The endless metallic belt according to claim 1, wherein the nickel alloy further contains at least one element selected from the second group of elements consisting of iron, cobalt, manganese and tungsten.

4. A fixing belt which comprises a metallic layer comprising an endless metallic belt, and a releasing layer;

the endless metallic belt is an endless metallic belt comprising a nickel alloy, and the nickel alloy containing at least one element selected from the first group of elements consisting of phosphorus, boron, silicon, germanium, selenium, antimony, tellurium, bismuth and astatine, and, in an X-ray diffraction pattern of which, half widths of X-ray diffraction peaks of the (111) crystal plane and (200) crystal plane are both from 0.5° to 2.5°.

5. A heat fixing assembly which comprises a fixing member having the shape of a belt and a member set opposed to the fixing member, where a transfer material holding thereon an unfixed image is made to pass a nip zone formed between the fixing member and the member set opposed thereto, to heat-fix the unfixed image to the transfer material;

the fixing member having the shape of a belt being a fixing belt comprising a metallic layer comprising an endless metallic belt, and a releasing layer;

the endless metallic belt comprising a nickel alloy, and the nickel alloy contains at least one element selected from the first group of elements consisting of phosphorus, boron, silicon, germanium, selenium, antimony, tellurium, bismuth and astatine, and, in an X-ray diffraction pattern of which, half widths of X-ray diffraction peaks of the (111) crystal plane and (200) crystal plane are both from 0.5° to 2.5°.

* * * * *